US005988555A

United States Patent [19]

Unruh et al.

[11] Patent Number: 5,988,555

[45] Date of Patent: Nov. 23, 1999

[54] CABLE WINDING MACHINE

[75] Inventors: Steve Unruh, Sharon Springs; Merle Koehn, Marienthal, both of Kans.

[73] Assignee: Completed Design, Inc., Marienthal, Kans.

[21] Appl. No.: 09/054,356

[22] Filed: Apr. 2, 1998

[51] Int. Cl.[6] ..... B65H 54/553; B65H 54/28; B65H 49/20

[52] U.S. Cl. ..... 242/470; 242/481.4; 242/485.5; 242/538; 242/557; 242/596.3; 242/596.7

[58] Field of Search ..... 242/470, 481.4, 242/481.5, 538, 397.3, 397.4, 399.2, 596.3, 596.7, 485.5, 486.8, 557, 473.6

[56] References Cited

U.S. PATENT DOCUMENTS

| | | | |
|---|---|---|---|
| 1,894,307 | 1/1933 | Ek | 242/485.5 |
| 2,310,036 | 2/1943 | Owens | 242/557 |
| 2,631,788 | 3/1953 | Cerasani | 242/485.5 |
| 2,682,997 | 7/1954 | Magnuson et al. | 242/481.4 |
| 4,190,210 | 2/1980 | Chirico | 242/596.7 |
| 4,699,330 | 10/1987 | Barazone | 242/596.3 |
| 4,767,073 | 8/1988 | Malzacher | 242/470 |
| 5,033,687 | 7/1991 | Bates | 242/596.3 |
| 5,312,057 | 5/1994 | Graham | 242/470 |
| 5,332,166 | 7/1994 | Kepes | 242/399.2 |
| 5,839,514 | 11/1998 | Gipson | 242/596.3 |

FOREIGN PATENT DOCUMENTS

| | | | |
|---|---|---|---|
| 295230 | 12/1988 | European Pat. Off. | 242/470 |
| 2658493 | 8/1991 | France | 242/470 |

*Primary Examiner*—John M. Jillions
*Attorney, Agent, or Firm*—Scott R. Zingerman

[57] ABSTRACT

An apparatus for winding material (such as cable, rope or paper or plastic webs) cable about a small reel from a large supply reel in which the cable is stored in bulk includes two arm units. One arm unit contains a first major arm section. A reel is carried between the distal ends thereof. Each arm unit also contains a minor arm extension. Each arm extension is connected to the major arm section by a vertical pin. There is a base. On that base, there are two upright brackets that are spaced apart. One bracket supports a first major arm section and the second bracket supports the second major arm section. There is a pivot on each bracket so that the major arm section can pivot up and down sort of like a modified teeter totter. Furthermore, the distal ends of the major arm sections can move either closer together or further apart. The inner ends of the major arm sections are connected to minor arm extensions by a vertical pin pivot. A cone is rotatably secured to the distal end of each major arm section. It is between these cones that the reel is supported. A leverage system controls the positions of the distal ends and cones.

22 Claims, 8 Drawing Sheets

CABLE WINDING MACHINE

BACKGROUND OF THE INVENTION

This invention relates to an apparatus for unspooling material from a supply spool and respool the material onto distribution reels. By specific example, this invention relates to an apparatus for unreeling cable from a large supply spool and rewinding at least a portion of it onto a smaller distribution reel.

In factories where cable or other lines such as rope, or webs such as paper or plastic sheeting are made, the finished product material is wound onto a large storage or supply spool, e.g. six feet in diameter or larger. These large storage spools can be shipped to any destination required. However, for most of the retail sale of the material which is shipped, it is required that the material be rewound, or respooled, onto a much smaller or retail type spool, e.g. approximately two to three feet in diameter.

It is an object of this present invention to disclose an apparatus for transferring material from a large supply spool to smaller retail type spools.

SUMMARY OF THE INVENTION

Disclosed is an apparatus for winding, or spooling, material (such as cable, rope, paper or plastic web) onto a small reel suitable for retail sale from material which is wound upon a large storage or supply reel (or spool). The apparatus includes a base with two upright spaced apart brackets. There are two spaced apart arm units rotatably supported from the brackets. Each unit has a major arm section which is parallel to the major arm section of the other unit. Each major arm section has a distal end and an interior end. The distal ends support a reel (or spool) therebetween in a rotatable manner. A cone is rotatably mounted to the distal end of each major arm section. The cones clampingly engage opposite ends of the reel or spool thereby alleviating the necessity of a rod extending through the spool between the distal ends of the major arm sections. At least one cone is angled or faceted to provide multiple friction points with the reel. By nature of the mechanism of the major arm sections, the apparatus is capable of securely lifting large diameter reels and also lifting small diameter reels without placing excessive (crushing) force on the small reel.

A plate and pivot are provided for supporting each major arm section from its associated bracket somewhat like a modified teeter-totter.

In a first configuration or embodiment, there is an arm extension having a first end and a distal end, said arm extension is pivotally attached at the first end by a vertical pin to the interior end of one major arm section. The distal end of the arm extension is of a character to support a take-up reel. There is a power mechanism to rotate the take-up reel about a support pin which extends between the distal end of each arm extension.

When the apparatus is used in this first configuration, the cable is unwound from the storage reel and passes through a counter and onto the take-up reel. The counter is of a type to measure the footage or linear length of the material that is spooled on the take-up reel. There is also means provided to move the counter laterally across the apparatus, i.e. in a direction perpendicular (transverse) to the path of travel of the cable. This permits a neat, or even winding of the cable upon the take-up (retail) reel.

In order to spool material from a major supply spool, such as one supported from a wall or the floor by an A-frame support, the arm extensions are not used or omitted completely in a second embodiment. The major supply spool is supported from a wall or the floor by an A-frame support such that the major supply spool is free to rotate in order to pay out material. In this second configuration or embodiment, the direction of linear travel of the material is reversed from the first configuration such that material is distributed from the major supply spool through the counter to a smaller retail reel which is supported by the major arm sections. The counter mechanism may be moved back and forth along a transverse axis (as discussed above) to evenly wind the material on the smaller retail spool supported between the cones of the major arm sections. A power mechanism rotates this take-up reel.

Power means are provided to rotate the arm units up and down about the pivot on the upright brackets. This permits either end of the arm unit to be raised and lowered above or toward the floor level. This permits the apparatus at the distal end of the major arm section to take-up or lower a large reel. The distal end of the arm extension can be raised and lowered to pick up or lower reels of a wide range of diameters.

The frame normally rests on a floor being supported by a back foot on each side and front crazy wheels (or casters). When it is desired to move the apparatus, larger wheels positioned adjacent the back feet are lowered to the floor. This raises the back feet from the floor and thus, the device can be pushed laterally easily in the direction of the large wheels. This is quite useful in moving both the supply spool and the retail spool. Crazy wheels are also provided adjacent the back feet such that when both the larger wheels and the back feet are raised from the floor, the device rolls freely in all directions on all four crazy wheels. This aids in maneuverability and positioning of the apparatus.

Thus it is an object to provide an apparatus for removing material from a large reel and depositing individual portions onto individual small reels.

It is a further object of the present invention to provide such an apparatus including the major arm sections which are capable of receiving spools of various diameters.

It is a still further object of the invention to provide an apparatus including cones to engage and rotate the spool.

These and other objects will be apparent from the description which follows when taken in conjunction with the drawings in which:

DETAILED DESCRIPTION OF THE PREFERRED EMBODIMENT

Figure 1:
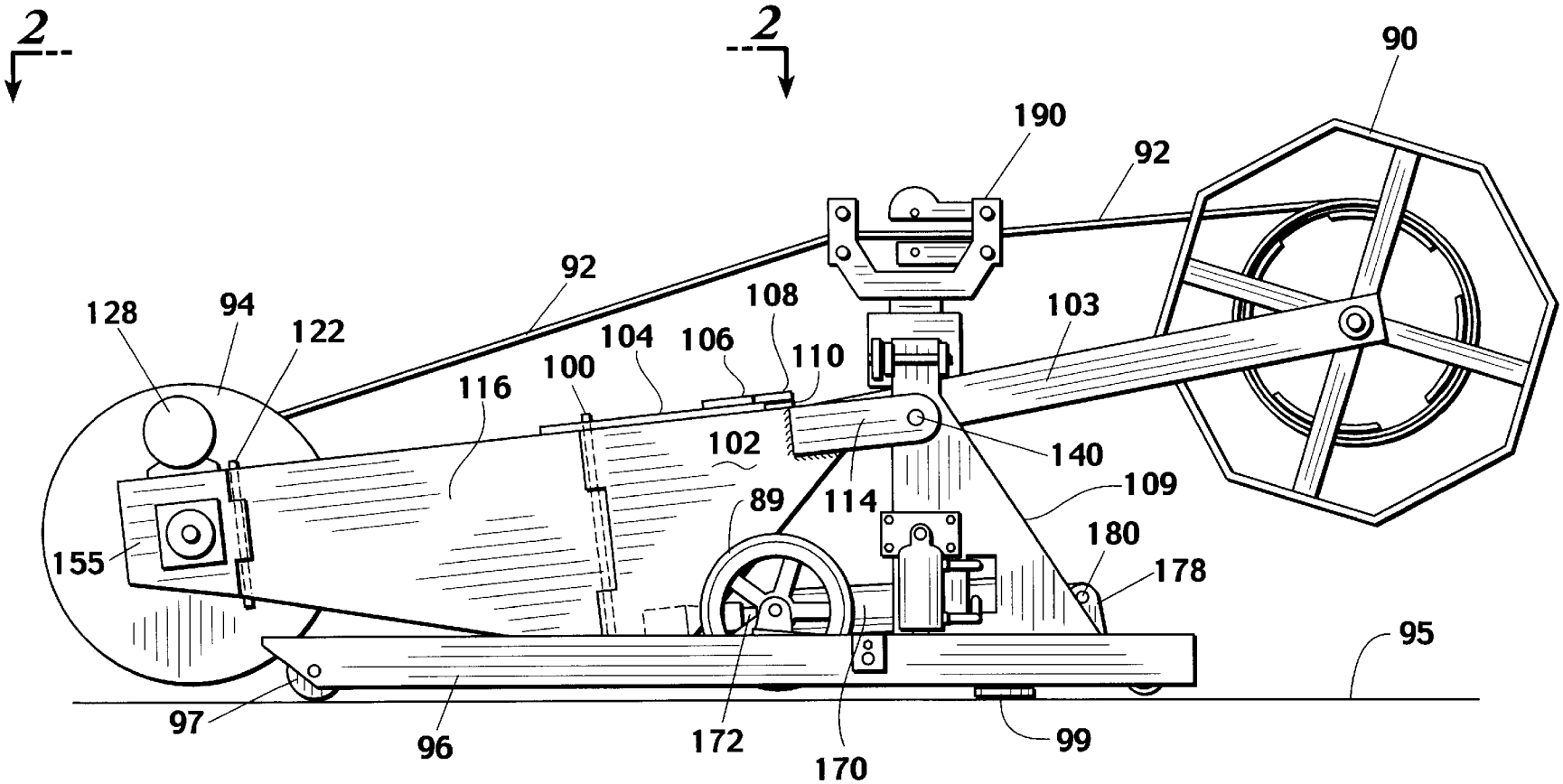
FIG. 1 is a side elevation view showing the preferred embodiment of my invention.

Attention is first directed to FIG. 1. Shown thereon is a side view of a first configuration or embodiment of the apparatus of this invention showing at one end a storage or supply reel 94 upon which is wound a supply of cable 92. The other end shows a small cable reel 90 upon which cable that is removed from the supply reel 94 is wound. This apparatus has an arm unit which includes major arm sections having a front arm 116 pivotally connected to a vertical plate 102 by a vertical pin 100. The arm unit also includes an arm extension 103 which is connected to vertical plate 102, such as by welding. Major arm section 116 can rotate about pin 100. Major arm section 116 is connected to reel holder box 155 by vertical pin 122 to permit minor rotation between arm 116 and box 155. There is a second major arm section on a second vertical plate 105 but spaced from vertical plate 102 shown.

As previously stated, there is an identical arm unit parallel to the arm unit just discussed in FIG. 1 which is spaced therefrom a distance of about four to five feet for example, although this distance can vary to suit the particular needs of the reels to be used. Referring to FIG. 1, cable 92 passes from supply reel 94 through counter 190 and onto reel 90. The counter is commercially available and is well known. The counter performs two functions. One, it measures the amount (liner length) of cable being transferred and it also moves laterally back and forth across the apparatus in an axis transverse to the axis of travel of cable 92 in order to have the cable align in a smooth orderly fashion on the take-up reel 90. This will be discussed further in regard to FIG. 5.

A side plate 114 is welded to plate 102. A vertical bracket 109 is connected to base 96. This bracket has a pin 140 about which side plate 114 may rotate in a vertical plane.

Figure 3:
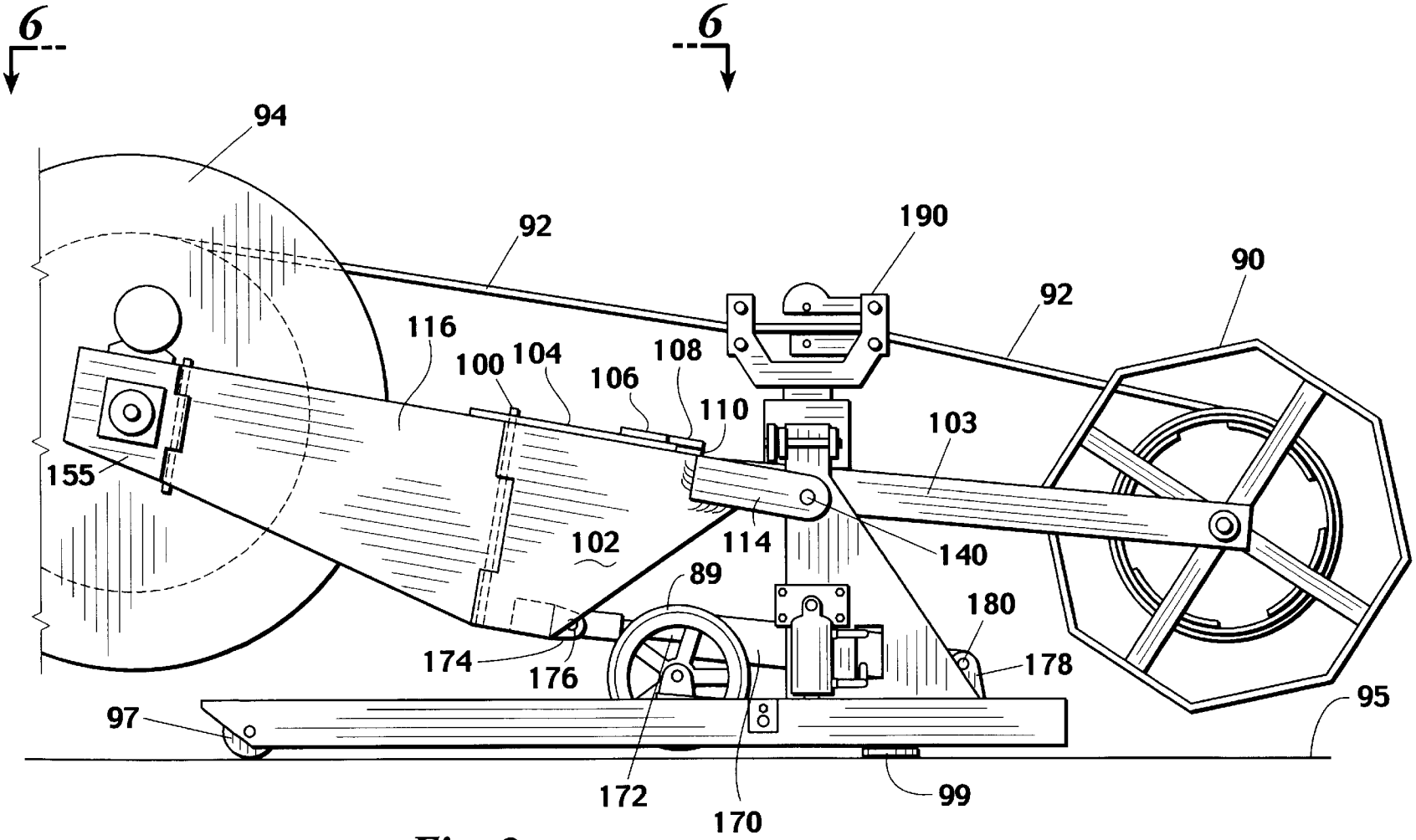
FIG. 3 is similar to FIG. 1 except that the arm system has been rotated to raise the supply spool and to lower the small reel spool.

As shown in FIG. 1, small take-up reel 90 is positioned at a much higher level than supply reel 94. In FIG. 3 the arm system has been rotated about pivot 140 whereby reel 94 is higher than the reel 90. Reel 90 is supported by the distal end of arm extension 103 in any known manner so that it can rotate about its axis. In the preferred embodiment, a pin is rotatably secured to the distal end of arm extension 103 extending through reel 90, around which reel 90 rotates.

Figure 4:
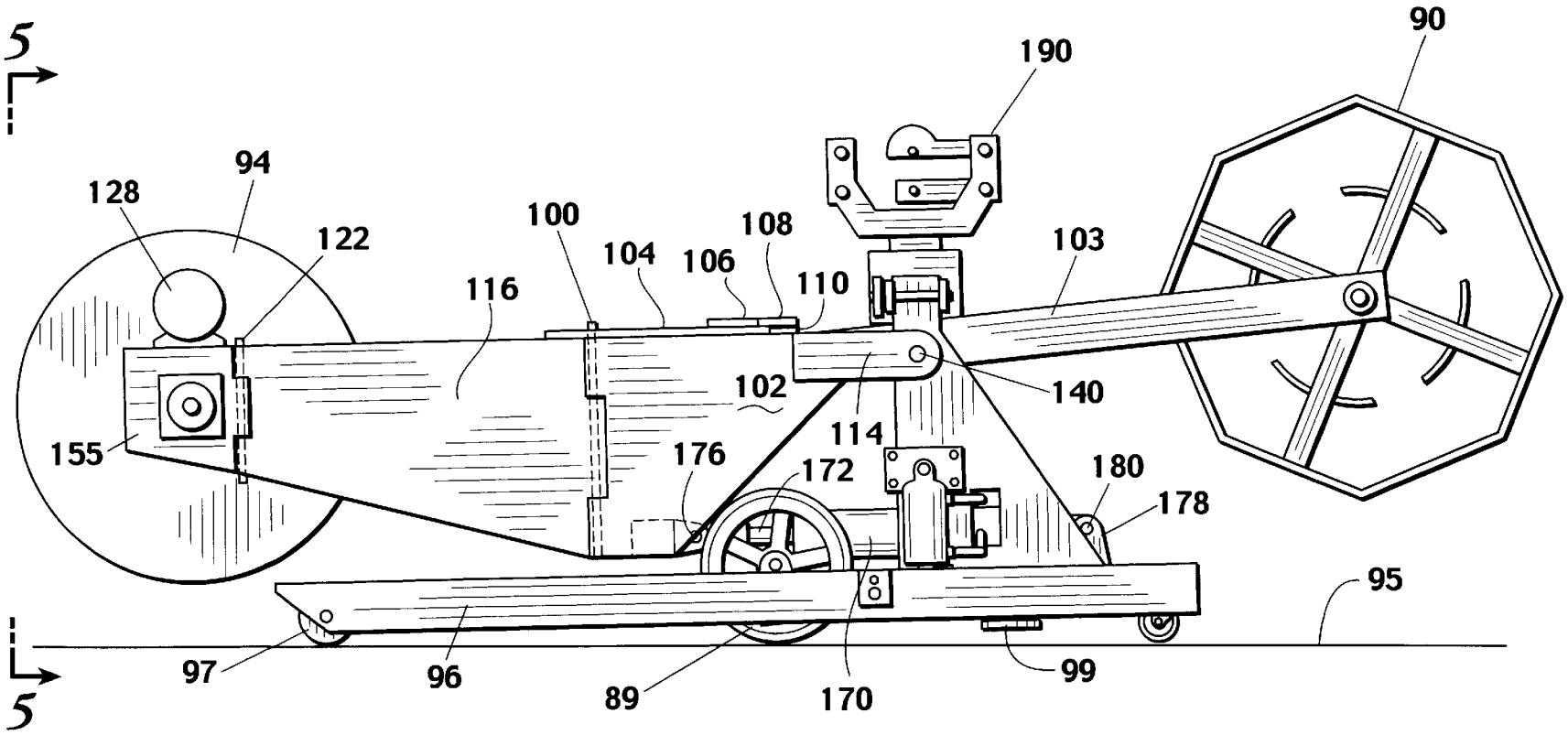
FIG. 4 is similar to FIG. 1 except that the arm units have been rotated and a part of the cable system has not been shown in order to show more clearly the support wheel is on the floor so that the apparatus can be moved about.

With reference to FIG. 4, means exists for rotating the arm unit about pivot 140. This includes a power cylinder 170 having power extension rod 172. One end of the cylinder 170 is pivotally connected to pin i80 and ear 178 which is welded or otherwise rigidly attached to the base 96. The distal end of the rod 172 is connected to pivot pin 176 which is supported by bracket 174 which is welded to plate 102. A second hydraulic cylinder having a rod is similarly connected to the opposite side of the apparatus. Tandem movement of the rods of the hydraulic cylinders cause arms 116 and 103 to rotate about pin 140 (connected by vertical plate 102). Different rotational positions for the arm unit is shown in FIG. 1, FIG. 3 and FIG. 4. This ability to rotate the arm units can be quite useful, especially when loading or unloading reels 90 and 94 from the arms.

Reference is made again to FIG. 1. As shown, reel 94 is near the floor 95. A small amount of additional rotation of the arm about pivot 140 can cause the reel 94 to rest upon floor 95. Thus, the reel can be unloaded, the apparatus moved and another reel added as will be explained more thoroughly later on. Likewise, reel 90 can be changed in a similar manner, however, reel 90 is typically of a size and weight to be carried by the user.

Means are provided for the rotation of reels 90 and 94. Such means generally include motors and linkage systems. The drive means for reel 94 is discussed below also in regard to FIG. 5.

The drive means for reel 90 includes a motor affixed to arm extension 103, (not shown) a sprocket affixed to the pin or shaft extending through reel 90 and a chain extending over the sprocket and over a second sprocket affixed to the shaft of the motor.

In the preferred embodiment this motor is a hydraulic motor, however, other known motors are equally suitable such as an electric motor. In operation, the motor rotates the second sprocket thereby actuating the chain which, in turn, rotates the first sprocket. Rotation of the first sprocket rotates reel 90. Power means for driving reel 90 is thereby defined.

Attention will next be directed particularly to FIG. 1 which shows the support for base 96. This includes casters or crazy wheels 97 at the left end of the base 96. These wheels can pivot 360 degrees. In FIG. 1, a back foot 99 is supporting the base 96. There will be a second foot on the opposite side of the apparatus, not shown.

Figure 8:
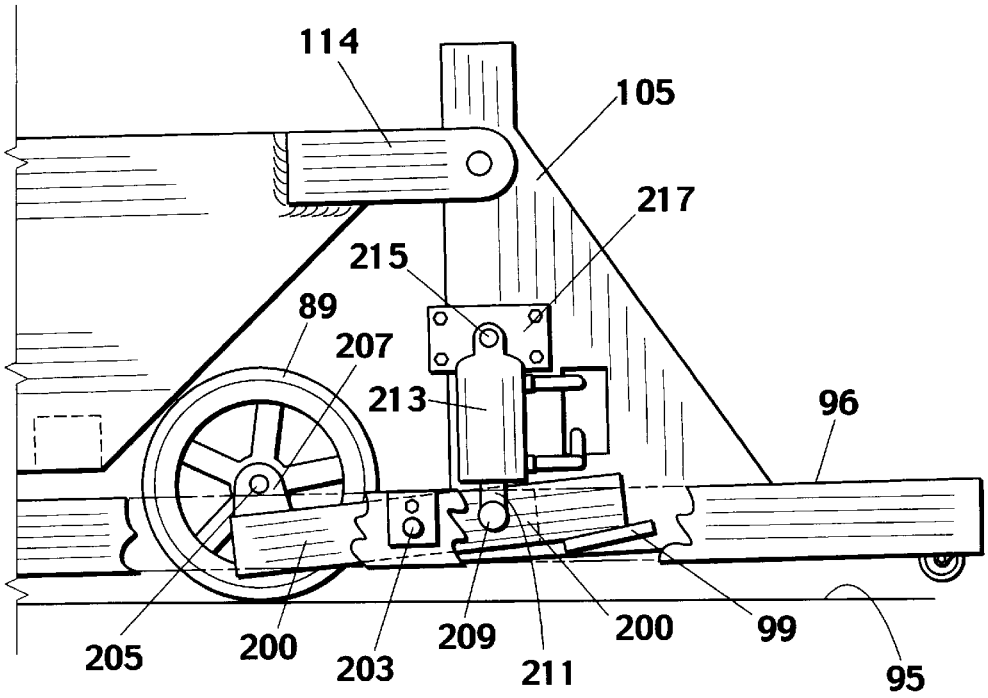
FIG. 8 is a view similar to FIG. 7 except that it shows that the support wheels have been lowered to the ground and the foot support for the frame has been raised so that the apparatus can be pushed about.
Figure 7:
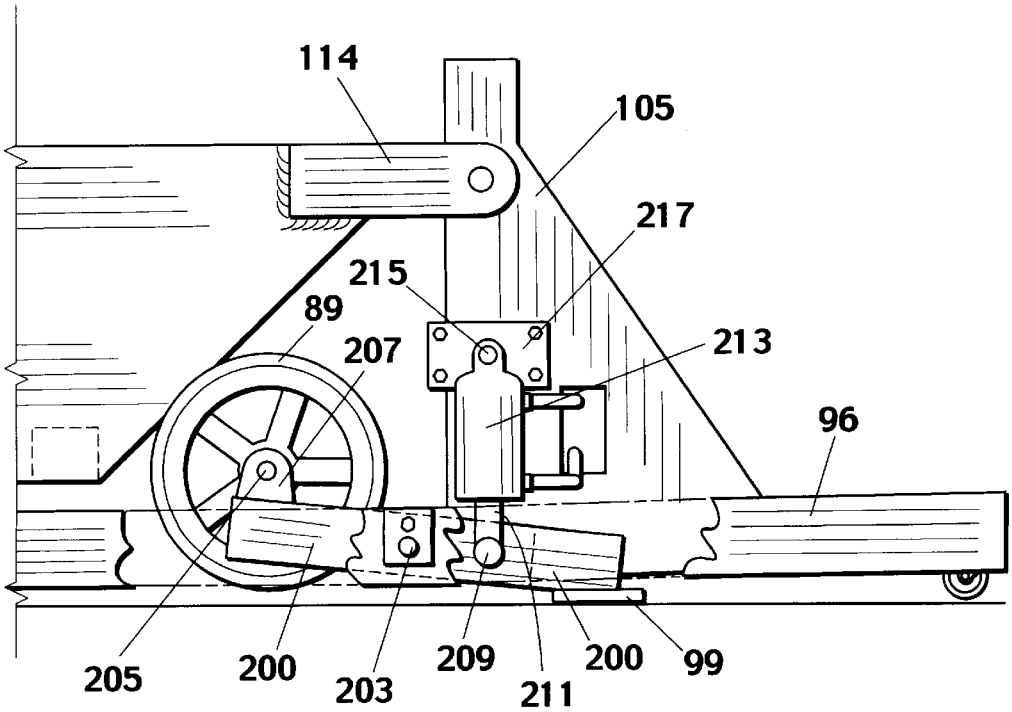
FIG. 7 illustrates the support wheel and the apparatus for lifting it.

I will now discuss the features of the apparatus which permit the apparatus to be transported by being pushed or pulled. This includes a transport wheel 89 which is shown in FIG. 1 raised above the floor 95. In FIG. 8, the transport wheel 89 has been lowered to the floor 95 with the base plate 96 raised slightly so that feet 99 are raised from the floor 95. I shall now discuss the mechanism for permitting this. This includes a lift bar 200 which acts as a lever and is supported by pivot pin 203 which is supported from base 96. Transport wheel 89 has an axle 205 which mates with a hole in ear 207 which is rigidly attached to the lift bar 200 at one end thereof. Foot 99 is positioned on the other end of lift bar 99. Lift bar 200 is provided with a pin 209 positioned along its length which is attached to piston rod 211. Piston rod 211 is operable by hydraulic cylinder 213. The body of cylinder 213 is supported by pin 215 on plate 217 which is firmly attached to bracket 105. Operation of cylinder 213 causes extension or retraction of rod 211. This causes lift bar 200 to rotate about pin 203 thereby alternately and oppositely raising and lowering wheel 89 and foot 99. Extension of the rod 211 causes wheel 89 to be lifted and alternately lowering foot 99 into contact with floor 95 as shown in FIG. 7. Reverse the movement of the rod 211 to where it is being retracted will cause wheel 89 to be lowered and alternately raising foot 99, as shown in FIG. 8. If sufficient lowering is made the feet 99 will be raised from the floor with wheel 89 contacting floor 95. In this position, the apparatus can be pushed on crazy wheels 97 and the transport wheels 89. There will, of course, be a transport wheel 89 on the other side of the apparatus which may be identical to that shown in FIGS. 7 and 8. This is generally for movement of the apparatus along the direction of wheels 89 so as to position the apparatus up to and away from an awaiting spool so that the major arm sections are in position to engage or disengage the spool.

As can be seen in FIGS. 7 and 8 (also FIGS. 1 and 4), a set of crazy wheels are also positioned on the right end of base 96. Rod 211 can be manipulated by cylinder 213 such that base 96 is resting on all four crazy wheels. In this position neither wheels 89 nor feet 99 are in contact with floor 95. Being supported by all four crazy wheels, the apparatus is free to be manipulated in any direction for ease in transport or positioning.

Figure 5:
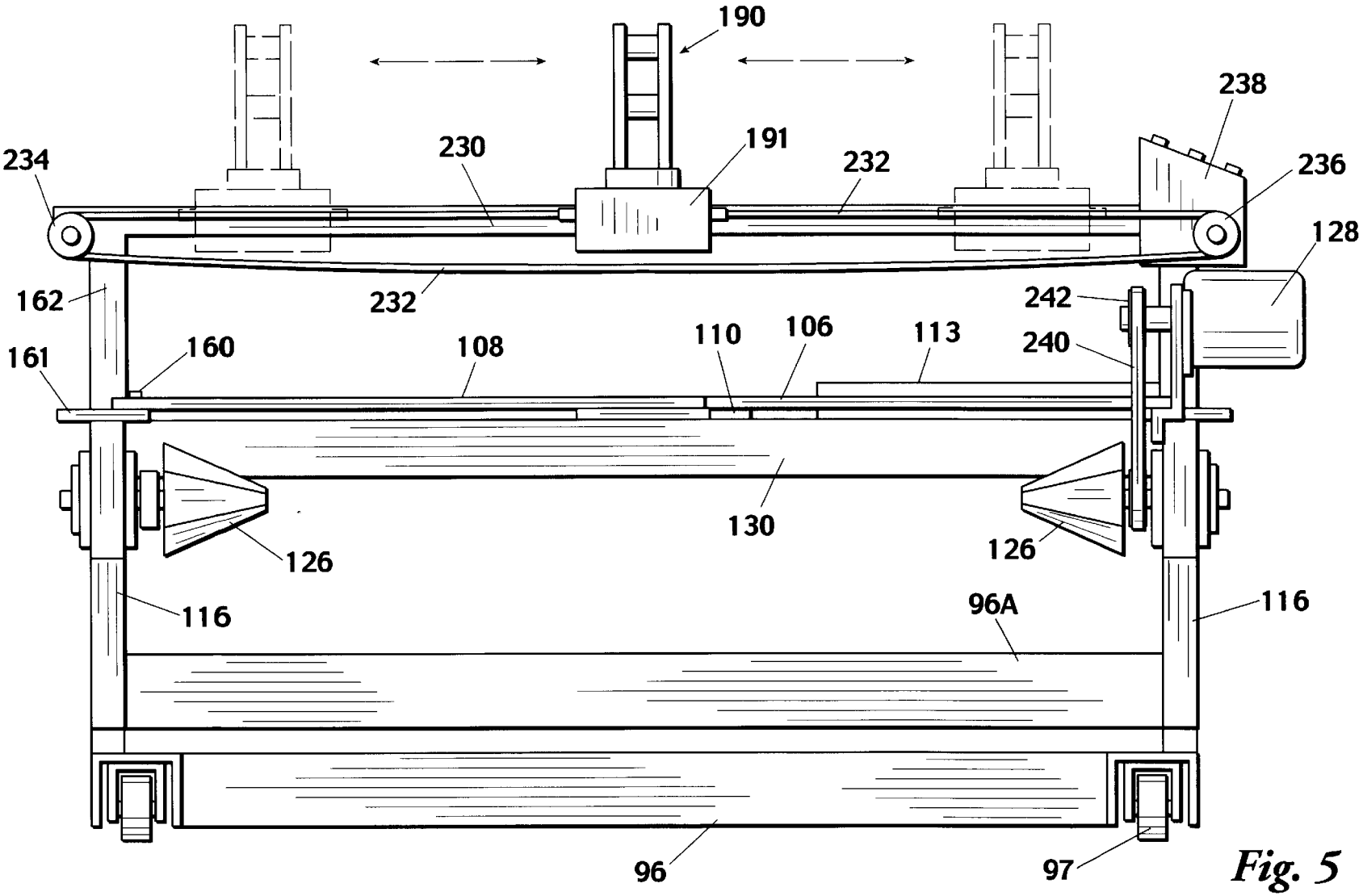
FIG. 5 is a view taken along the line 5—5 of FIG. 4 without the reel.

Attention is next directed to FIG. 5 in particular to show the mechanism used for driving counter 190 laterally across the apparatus. Shown thereon is the counter 190 with base 191 which travels back and forth on rail 230. A drive chain 232 extends from and is attached to one side of base 191 (on the left) around sprocket 234 and then returns beneath the base 191 and around drive sprocket 236 back to base 191 to which it is attached. This drive sprocket is driven by a hand crank (not shown) extending through a control box 238. Counter 190 travels back and forth on rail 230 by turning the crank in the desired direction which rotates drive sprocket 236 and thereby drives chain 232 around sprocket 234. In an alternate embodiment, the hand crank could be substituted for a motor having controls in control box 238. Controls for driving a motor in one direction a certain number of revolutions and reversing that in another number of revolutions is well known. A brace 96A is shown and is just above base 96 and is connected to plates 102.

Additionally shown in FIG. 5 are means wherein a reel (such as the reel 94 in FIG. 1) can be driven. The reel is supported by two conical supports 126, one supported from the end of each arm extension 116 (one on the left and one on the right). This type cone can support a reel without the necessity of a shaft or axle. Cones 126 have facets or edges to improve frictional contact with the axle end of the reel 94. It has been found that it is preferable for at least one cone 126 to include these facets.

Faceted cones 126 are defined by a plurality of triangular planar surfaces forming their circumference. Reels or spools of this sort commonly have a hole for receiving a rod or axle. Cones 162 are inserted into these holes on each side of the spool thereby pinching or gripping the spool. In the preferred embodiment, cones 126 are hexagonal, however, other geometric configurations are contemplated.

The drive means of FIG. 5 includes a drive chain 240 driven by sprocket 242 which is driven by motor 128. In the preferred embodiment, motor 128 is a hydraulic motor including drag valves therein, however, it is understood that other known types of motors, such as a variable speed electric motor is equally suitable. Chain 240 then drives the sprocket connected to cone 126. The rate of rotation of the cone 126 should be coordinated with the lateral or transverse movement of counter 190 to obtain a smooth wind of the cable on reel 90 (FIG. 1). Cones 126 are supported preferably by a bearing assembly. This drive means (motor 128) can free wheel in reverse such that rotation of spool 90 pulls cable freely from spool 94 as in FIG. 1. The hydraulic motor of the preferred embodiment includes drag valves which can be used as a brake to slow or stop the rotation of spool 94. For example, inertial rotation of spool 94 can be stopped when spool 90 is full and ceases rotation.

As mentioned earlier the hexagonal cones 126 can be moved closer together or farther apart by the apparatus of this invention. The clamping force between cones 126 is varied depending on the size of the reel. In this regard, attention will be directed to FIG. 2. Shown thereon is a horizontal support bar 130 which is fixed at each end to pivot support bars 102A (supported from plate 102). At about the middle of horizontal support bar 130 is an ear 131 (shown in phantom) which supports a pivot pin 112. Major arm sections 116 and 104 which are welded together as a unit are pivotally connected to pivot support 102A by pivot 100. The other end of arm 116 is connected to pivot 122 which is supported by base 155 which supports hexagonal cone 126. A turnbuckle 118 is connected between pivot pin 124 on arm 125 which is connected to pivot support bar 102A. The other end of turnbuckle 118 is connected to base 155 by pivot pin 120. Thus there is a parallelogram defined by pivot pins 120, 122, 100 and 124. Turnbuckle 118 is used for fine adjustment of this parallelogram. The parallelogram arrangement defined by pivot 100, 124, 120 and 122 keeps the axis or cones 126 in alignment with the ends of spool 94. It is noted that the drive means for reel 94 is not shown in FIG. 2 for ease of describing the leverage system.

Figure 6:
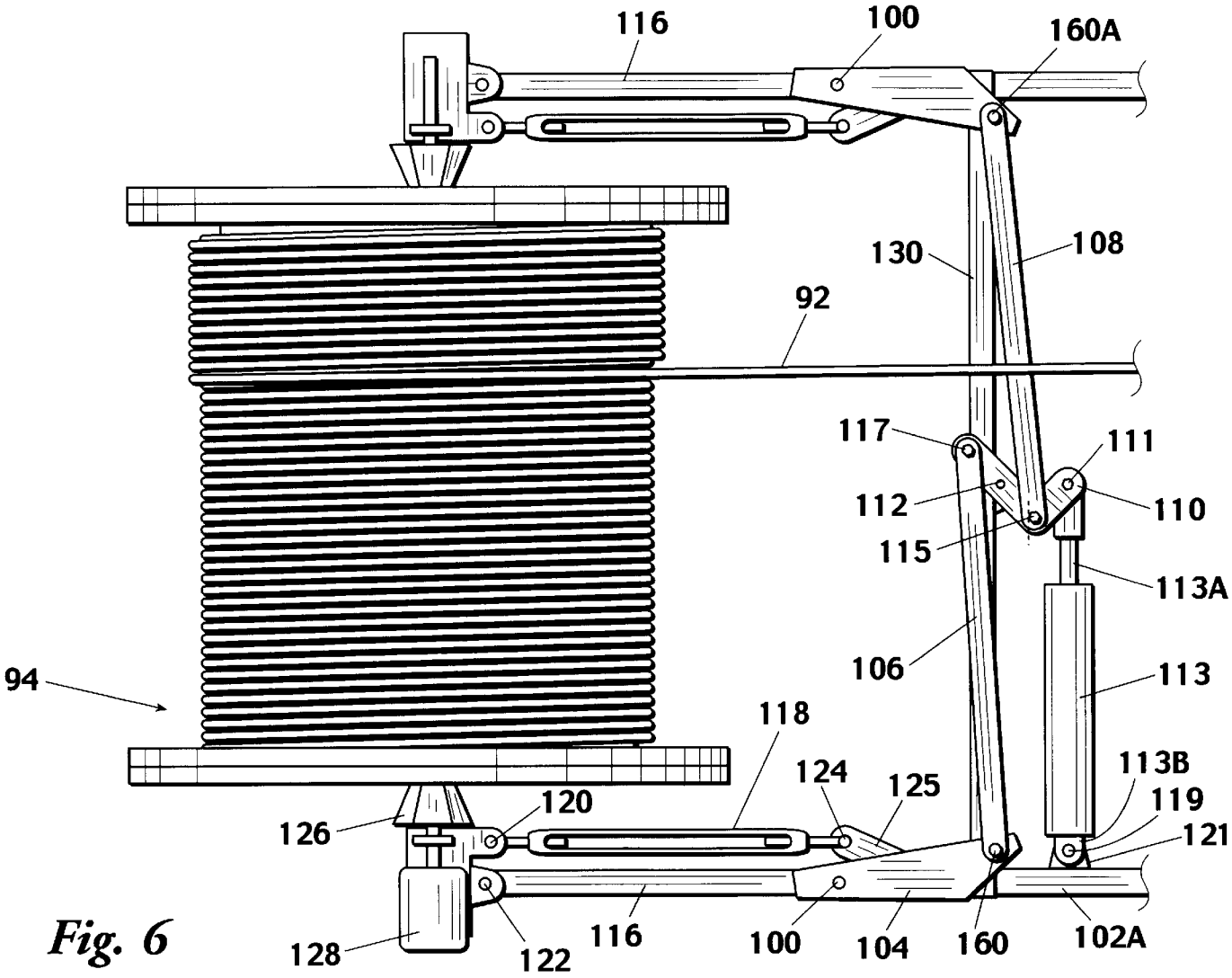
FIG. 6 is a view taken along the line 6—6 of FIG. 3.

There exists a first actuating arm 106 which is connected to pivot pin 160 to arm plate 104. There is also provided a second actuating arm 108 which connects at one end to pivot pin 160A which is connected to arm plate 104. Means for connecting the two horizontal actuating arms 106 and 108 will now be described. This includes an L-shaped member 110 which has two legs at 90°. The L-shaped member is pivoted at pin 112 which extends from ear 131 which may be a part of or attached to horizontal support bar 130. Pivot pin 117 on the lower end of leg connector 110 is pivotally connected to actuator arm 106. The other end of actuator arm 106 is pivotally connected by pin 160 which is supported from plate 104. The other actuating arm 108 has a hole in it to receive pivot pin 115 which is located at the junction of the two arms of L-shaped member 110. The other end of actuating arm 108 is pivotally connected to pin 160A which is supported by arm plate 104. As L-shaped member 110 is rotated about pivot 112, actuating arms 106 and 108 will be moved to move arms 104 about pivot pins 100. This will cause the cones 126 to move either closer together or farther apart. FIG. 6 shows them moved farther apart whereby the member 116 is essentially perpendicular to the arms 106 and 108 to support a smaller diameter reel or spool 94.

Movement of L-shaped member 110 is obtained by a hydraulic cylinder 113 which has an extension rod 113A which is connected by pivot pin 111 to the short leg of L-shaped member 110. The other end of the cylinder 113 is provided with an ear 113B which receives pivot pin 119 which is supported from one ear 121 which is supported from plate 102A. Thus, by actuating cylinder 113 the levers will be moved to vary the distance between the cones 126 as may be desired. The force exerted by cylinder 113 remains constant throughout its path of travel. However, it is a feature of the invention that the clamping force exerted by cones 126 varies throughout the path of travel of cylinder 113 due to the above described mechanism including the movement of L-shaped member 110. Specifically, L-shaped member 110 provides varying mechanical leverage forces on actuating arms 106 and 108.

Figure 2:
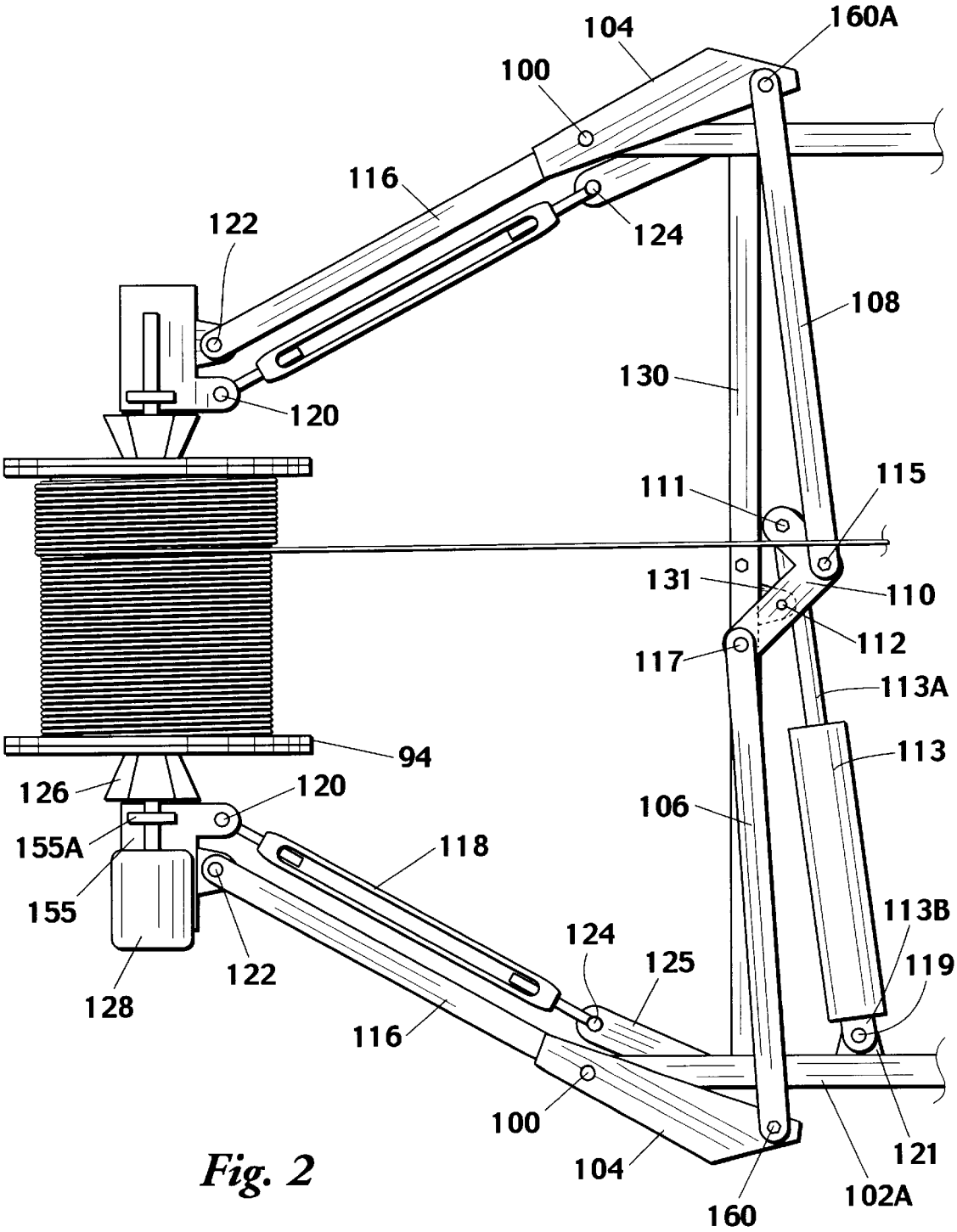
FIG. 2 is a view taken along the line 2—2 of FIG. 1.

When comparing FIG. 2 and FIG. 6, FIG. 2 depicts the clamping apparatus of this invention wherein a small reel is supported between cones 126. FIG. 6 depicts the clamping apparatus of this invention wherein a large reel is supported between cones 126 such that cones 126 are spread apart the maximum distance provided by the apparatus. It has been found that the force placed on the smaller reel shown in FIG. 2 is less than the force placed on the larger reel of FIG. 6 due to movement of L-shaped member 110 through the path of travel of cylinder 113. This variation in leverage force is due to the shape and path of travel of L-shaped member 110.

An apparatus as described herein has been built. The dimensions of such device in part are as follows: The distance between pivot pin 112 and 117 is 4.5 inches. The distance between pin 111 and 115 is about 3.75 inches and between pivot 117 and 115 is 9 inches; 118 and 112 is 4.5 inches. The distance of actuating arm 106 between pivot 117 and 160 is about 24 inches. The length of actuating arm 108 between pivot 160A and pivot 115 is about 3.25 inches. Hydraulic cylinder 113 includes a rod 115 having an extension of travel equal to 12 inches. The length between pivot 100 and 160 is about 8.5 inches and between 122 and 100 is about 29.75 inches. The distance between reels 90 and 94 is about 7 feet, center to center. These dimensions are to give an example of a constructed apparatus and are in no way limiting. The materials used shall be of a type using good engineering standards.

Figure 9:
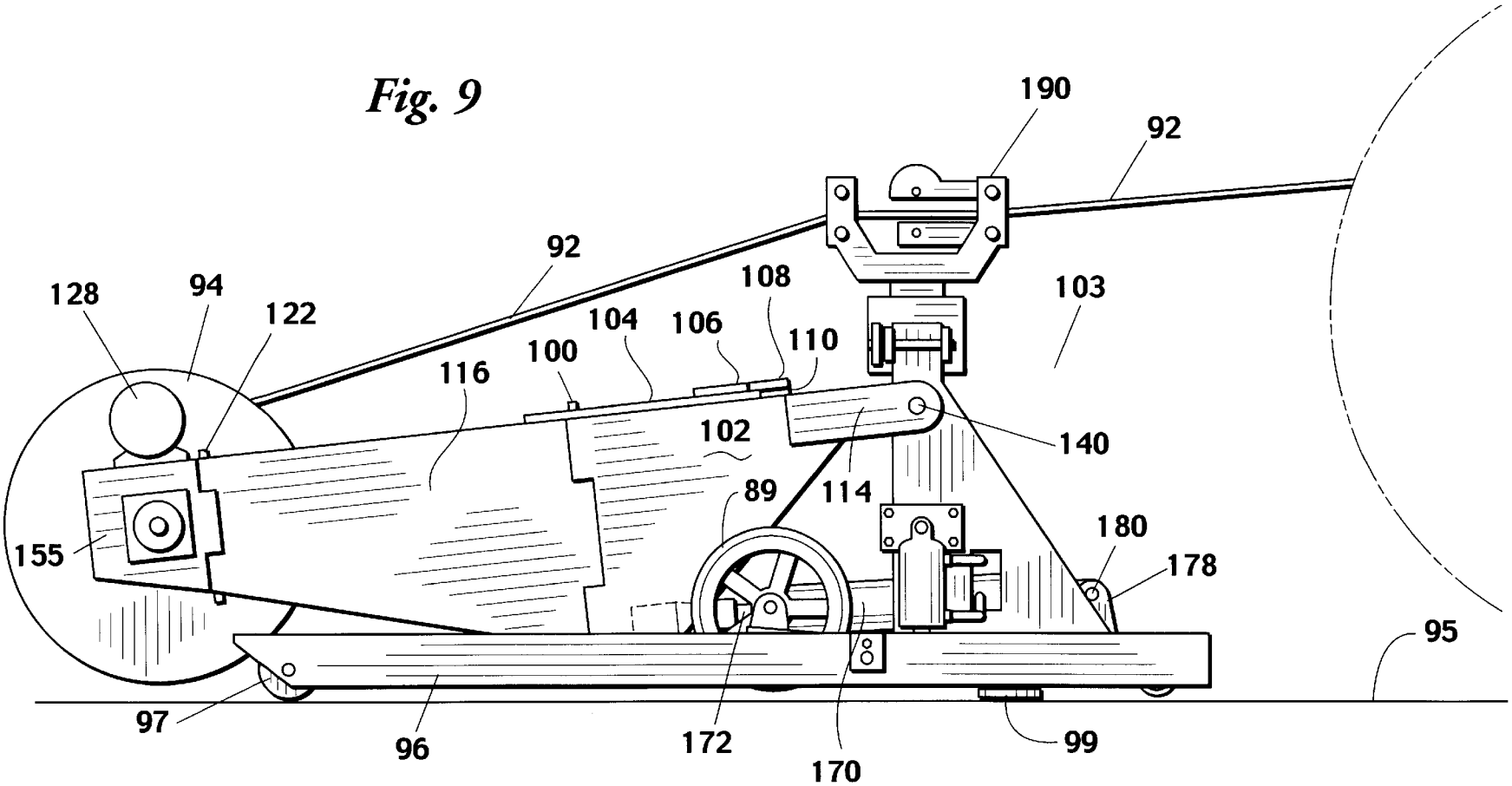
FIG. 9 is a view similar to FIG. 1 except that the arm extension is omitted such that the supply reel is a free standing major supply spool and the take-up reel is supported by the major arm sections of the invention.

FIG. 9 depicts a second configuration of the present invention wherein cable is being dispensed from a large external supply spool to a smaller take-up reel which is supported by major arm sections 116. In this configuration, arm extension 103 is idle (not used) with reel 90 (of FIG. 1) removed. In a second embodiment of the present invention, arm extension 103 (of FIG. 1) would be omitted completely. In all other respects this second embodiment is identical to and operates in the same manner as the first embodiment.

It is common in locations where cable is transferred for the supply spool to be large (10' in diameter and larger) and mounted to a wall or on a frame such as an A-frame. FIG. 9 depicts such a large supply spool shown in phantom. It is common and necessary for the large supply spool to be freely rotatable in order to pay out cable.

In this second configuration, cable 92 extends off from the large externally mounted supply spool through counter 190 and onto what is now take-up reel or spool 94. In all other respects the apparatus operates in the same way. Counter 190 is capable of counting the linear length of cable 92 dispensed in this opposite direction and also able to move transversely in order to evenly wind cable 92 onto spool 94.

Cable 92 is wound onto reel 94 by rotation of reel 94 using the drive means discussed above with regard to FIG. 5. Motor 128, affixed to major arm extension 116 and including a sprocket and drive chain which meshes with a sprocket secured to a cone (126 of FIG. 2), provides the drive means to rotate reel 94. Rotation of reel 94 winds cable 92 onto reel 94 from the supply spool.

Thus, it is apparent that there has been provided, in accordance with the invention, a cable winding machine that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. An apparatus for winding material onto a small or retail reel from a supply of material from a storage reel, comprising:

a base;

a first and a second spaced major arm section, each having a distal end and an inner end;

a bracket supporting each said major arm section from said base;

a pivot for supporting each said major arm section from each said bracket;

the distal end of each said major arm section including a cone thereon to support a reel;

at least one of said cones being defined by a plurality of integral triangular planar surfaces forming edges for gripping the interior of the reel;

a powered leverage to move the distal ends of said major arm sections including said cones thereon closer together or further apart;

each said major arm section being capable of pivoting with respect to said bracket.

2. An apparatus as defined in claim 1 including means for rotating said cones.

3. An apparatus as defined in claim 1 including power means for pivoting said major arm sections with respect to said bracket.

4. An apparatus as defined in claim 1 including:

an arm extension having a distal end and an inner end;

said inner end of said arm extension being secured to said first major arm section so as to be capable of pivoting therewith;

said distal end of said arm extension being of a character to support the retail reel;

means for rotating said retail reel.

5. An apparatus as defined in claim 1 including:

a roller at one end of said base and feet at the opposite end for supporting the base from a floor;

a support wheel having an axle;

a power means having a power rod;

a bar connected between said power rod and the axle of said support wheel whereby said wheel may be lifted above or lowered toward the level of the feet so that the wheel contacts the floor and thereby raises the feet from the floor so that the apparatus may be pushed about easily.

6. An apparatus as defined in claim 1 including:

a counter with a base, said counter being of a character to receive a cable and measure the linear length passed therethrough;

a rail for supporting said counter base;

a first sprocket mounted on one end of said rail and a second sprocket connected to the other end of said rail;

a sprocket cable having two ends, one end connected to one side of said base the other end to the other side of said base, said cable looping around said first and second sprocket;

means for driving said second sprocket alternately in different directions.

7. An apparatus as defined in claim 1 wherein said powered leverage includes:

a horizontal support bar supported from and fixed to said bracket and having a first end and a second end;

a first pivot support bar supported from one end and a second pivot support bar supported from the other end of said horizontal support bar;

the distal end of said major arm section having a second pivot pin;

a support plate positioned at the end of said arm section, a second and a third pivot pin supported from said support plate;

a pivot support bar extension extending from said pivot support bar and having a fourth pivot pin;

the second pivot pin connecting the major arm section to the support plate;

said first, second, third and fourth pin defining a parallelogram;

a turnbuckle extending from said fourth to said third pivot pin and said arm extension extending in part from said first and said second pivot pin;

a first actuating arm and a second actuating arm;

an L-shaped pivot bar having a first leg and a second leg, fifth pivot pin pivotally supporting said L-shaped pivot bar from said horizontal support bar;

one end of said L-shaped pivot bar having a sixth pivot pin and the other leg having a seventh pivot pin and an eighth pivot pin at the junction of the two legs of said L-shaped pivot member, one end of said actuating arm connected to said fifth pivot and to said sixth pivot and the second actuating arm pivotally connected at one end to said eighth pivot and at the other end to a ninth pivot pin in the second bracket;

a piston with an extension rod, one end of said piston rod connected to said seventh pivot and the housing of said cylinder pivotally connected to said support bar;

whereby movement of said extension rod from said cylinder moves the distal ends of the arms either closer together or farther apart to accommodate different size reels.

8. An apparatus for winding material onto a small take-up reel from a supply reel, comprising:

a base;

two spaced apart upright brackets supported on said base;

a first and a second vertical plate;

a pivot on each bracket supporting each vertical plate;

a first and a second major arm section each having a distal end and an inner end;

at least one arm extension having an inner end and a distal end;

a first vertical pin connecting said first major arm section at its inner end to said first vertical plate to form a first arm unit and a second vertical pin connecting said inner end of said second major arm section to said second vertical plate such that said first and said second major arm sections can rotate horizontally about their respective vertical pins;

means for securing said inner end of said arm extension to said second vertical plate opposite said second major arm section to form a second arm unit;

said second arm unit being capable of pivoting on said pivot;

the distal ends of said first and second major arm sections being of a character to support either a supply reel or a take-up reel;

the distal end of said arm extension being of a character to support a take-up reel.

9. An apparatus as defined in claim 8 including:

a second arm extension having an inner end and a distal end;

means for securing said inner end of said second arm extension to said first vertical plate opposite said first major arm section to form said first arm unit;

the distal ends of said arm extensions being of a character to support a take-up reel.

10. An apparatus as defined in claim 9 including means to rotate each said arm unit about the pivot means on each bracket and to hold them in a selected rotational position.

11. An apparatus as defined in claim 8 including crazy wheels on at least one end of the base and feet on the other end and further including a transport wheel supported in an opening in said base and means to raise and lower said transport wheel with respect to the base whereby lowering the wheel to the floor raises the base and the feet so that the apparatus can be pushed about.

12. An apparatus for winding material onto a small or retail reel from a supply of material from a storage reel which comprises:

a base;

a first and a second spaced apart support arm member, each having a first end and a second end;

a bracket supported from said base;

a pivot for supporting each said arm support member near the first end from said bracket;

an arm section for each arm support member pivotally attached at the inner end of said arm support member by a first vertical arm pivot pin;

the distal end of each said arm section being of a character to support a reel;

a powered leverage to move the distal ends of said arm sections closer together or further apart;

a roller at one end of said base and support feet at the opposite end for supporting the base from a floor;

a support wheel having an axle;

a power means having a power rod;

a lift bar connected between said power rod and the axle of said support wheel whereby said wheel may be lifted above or lowered toward the level of the feet so that the wheel contacts the floor and thereby raises the feet from the floor so that the apparatus may be pushed about easily.

13. An apparatus as defined in claim 12 in which a cone for gripping the interior of the reel is rotatably connected to the distal end of each said arm section.

14. An apparatus as defined in claim 13 wherein at least one of said cones is defined by a plurality of integral triangular planar surfaces forming edges for gripping the interior of the reel.

15. An apparatus as defined in claim 14 wherein the cone is defined by six of said triangular planes.

16. An apparatus as defined in claim 12 including:

a horizontal support bar supported from and fixed to said bracket and having a first end and a second end;

a first pivot support bar supported from one end and a second pivot support bar supported from the other end of said horizontal support bar;

the distal end of said arm section having a second pivot pin;

a support plate positioned at the end of each arm section, a second and a third pivot pin supported from said support plate;

a pivot support bar extension extending from said pivot support bar and having a fourth pivot pin;

the second pivot pin connecting the arm section to the support plate;

said first, second, third and fourth pin defining a parallelogram;

a turnbuckle extending from said fourth to said third pivot pin and said arm section extending in part from said first and said second pivot pin;

a first actuating arm and a second actuating arm;

an L-shaped pivot bar having a first leg and a second leg, fifth pivot pin pivotally supporting said L-shaped pivot bar from said horizontal support bar;

one end of L-shaped pivot bar having a sixth pivot pin and the other leg having a seventh pivot pin and an eighth pivot pin at the junction of the two legs of said L-shaped pivot member, one end of said actuating arm connected to said fifth pivot and to said sixth pivot and the second actuating arm pivotally connected at one end to said eighth pivot and at the other end to a ninth pivot pin in the second arm section;

a piston with an extension rod, one end of said extension rod connected to said seventh pivot and the housing of said cylinder pivotally connected to said support bar;

whereby movement of said extension rod from said cylinder moves the distal ends of the arm sections either closer together or farther apart to accommodate different size reels.

17. An apparatus as defined in claim 12 including:

crazy rollers at one end of said base and second set of crazy wheels at the opposite end of the base;

a horizontal pivot pin supported by said base adjacent said support wheel;

said lift bar pivotally mounted about said horizontal pivot;

said power means being a power cylinder having a power rod pivotally attached to said lift bar;

the other end of said lift bar pivotally supporting the said axle of the support wheel;

said support feet being connected to the other end of said lift bar whereby extending and retracting the power rod causes the lift bar to rotate about the horizontal pivot thus raising and lowering the support wheel from a position where it contacts the floor and to a second position whereby the support feet contact the floor with an intermediate position whereby both support feet and power wheel are not in contact with the floor.

18. An apparatus for engaging a reel, comprising:

a base;

a first major arm section and a second major arm section supported from said base;

an L-shaped member defined by a first leg and a second leg connected at a junction point and terminating at a distal end;

said L-shaped member being pivotally supported from said base at a pivot point between said first major arm section and said second major arm section;

a piston pivotally secured to said base with a rod extending from said piston and pivotally connected to said distal end of said second leg;

said rod capable of extension and retraction in response to actuation of said piston;

a first actuator arm extending from said first major arm section to said distal end of said first leg;

a second actuator arm extending from said second major arm section to said junction point;

said first actuator arm is capable of actuating said first major arm section and said second actuator arm is capable of actuating said second major arm section when said L-shaped bracket pivots about said pivot point in response to a force exerted on said distal end of said second leg by said rod actuated by said piston such that a force is applied from said first leg to said first actuator arm and from said junction point to said second actuator arm.

19. An apparatus as defined in claim 18 including:

an arm extension having a distal end and an inner end;

said inner end of said arm extension being secured to said first major arm section so as to be capable of pivoting therewith;

said distal end of said arm extension being of a character to support the retail reel;

means for rotating said retail reel.

20. An apparatus as defined in claim 18 including:

a roller at one end of said base and feet at the opposite end for supporting the base from a floor;

a support wheel having an axle;

a power means having a power rod;

a bar connected between said power rod and the axle of said support wheel whereby said wheel may be lifted above or lowered toward the level of the feet so that the wheel contacts the floor and thereby raises the feet from the floor so that the apparatus may be pushed about easily.

21. An apparatus as defined in claim 19 in which a cone for gripping the interior of the reel is rotatably connected to the distal end of each said major arm section.

22. An apparatus as defined in claim 21 wherein at least one of said cones is defined by a plurality of integral triangular planar surfaces forming edges for gripping the interior of the reel.

* * * * *